United States Patent [19]

Ellis

[11] 4,190,303

[45] Feb. 26, 1980

[54] TABLE FOR USE IN RELIGIOUS SERVICES

[76] Inventor: Juanita W. Ellis, Rte. 1, Box 399-A, Henderson, Ky. 42420

[21] Appl. No.: 921,898

[22] Filed: Jul. 5, 1978

[51] Int. Cl.[2] ..... A47B 19/00

[52] U.S. Cl. ..... 312/33; 248/458; 312/196

[58] Field of Search ..... 312/33, 196; 248/458; 108/94, 104, 77; 35/23 R

[56] References Cited

U.S. PATENT DOCUMENTS

| | | | |
|---|---|---|---|
| 119,316 | 9/1871 | Carter et al. | 312/196 |
| 155,101 | 9/1874 | Mortimer | 248/458 |
| 301,345 | 7/1884 | Dupin et al. | 248/458 |
| 1,506,669 | 8/1924 | Sabiston | 108/94 |
| 2,933,359 | 4/1960 | Fizdale | 108/77 |
| 3,715,815 | 2/1973 | Lewis | 312/196 |
| 3,828,695 | 8/1974 | Skarky | 312/209 |

*Primary Examiner*—Alexander Grosz
*Attorney, Agent, or Firm*—Maurice L. Miller, Jr.

[57] ABSTRACT

A table having a broad, multi-sided top forming a regular octagon supported by a column mounted on a broad base at a height above the floor convenient for kneeling therearound is disclosed. A rotatable lectern is mounted on the table top so that the same can be aligned for use by a person kneeling at any one of the eight sides. The table top may be constructed to form a stationary central portion with four drop leafs attached to the central portion as a space saving feature.

6 Claims, 5 Drawing Figures

TABLE FOR USE IN RELIGIOUS SERVICES

BACKGROUND OF THE INVENTION

This invention relates generally to furniture or furnishings containing a lectern for use in conducting religious services.

Lecterns for use in religious services are, of course, well known to the prior art. Moreover, it is generally known that a lectern may be combined with other furnishings or furniture such as disclosed in U.S. Pat. No. 3,123,414 issued to R. L. Rupp on Mar. 3, 1964 entitled "Combination Pulpit and Register Desk". In that particular patent, a book or scripture supporting lectern is disclosed which is removably mounted on a pulpit or register desk. The reference lectern may be positioned for use by an individual standing at the open back side of a three-sided desk wherein the combination forms an attractive pulpit from which a sermon may be delivered. By lifting the lectern from its mounting on the top of the desk and turning it around 180 degrees, the lectern may be re-mounted on the desk for use by a person standing at the enclosed front of the desk as a convenient register desk of the general appearance often found in funeral homes, church vestibules and so forth.

However, none of the lecterns used in combination with furnishings in the prior art are adapted to rotate around a multi-sided table for shared use by numerous persons located at each of the sides. My invention overcomes this and other disadvantages of the prior art.

SUMMARY OF THE INVENTION

It is an object of my invention to provide a table for use in religious services and otherwise which includes a rotatable lectern mounted on a multi-sided table top disposed at a height above the floor which is convenient for numerous persons to kneel around.

It is another object of my invention to provide a multi-sided table with rotatable lectern attached for use in conducting religious services wherein numerous persons may kneel therearound, the table being adaptable for a variety of other uses in the home when not needed for its principal purpose.

Briefly, in accordance with my invention, I provide a table for use in religious services and otherwise which includes a multi-sided table top, and a rotatable lectern mounted on the table top for rotation into alignment with each of the sides of the table top.

These and other objects of the present invention will become apparent to those skilled in the art from the following detailed description and attached drawings upon which, by way of example, only the preferred embodiments of my invention are illustrated.

DESCRIPTION OF THE PREFERRED EMBODIMENTS

Figure 1:
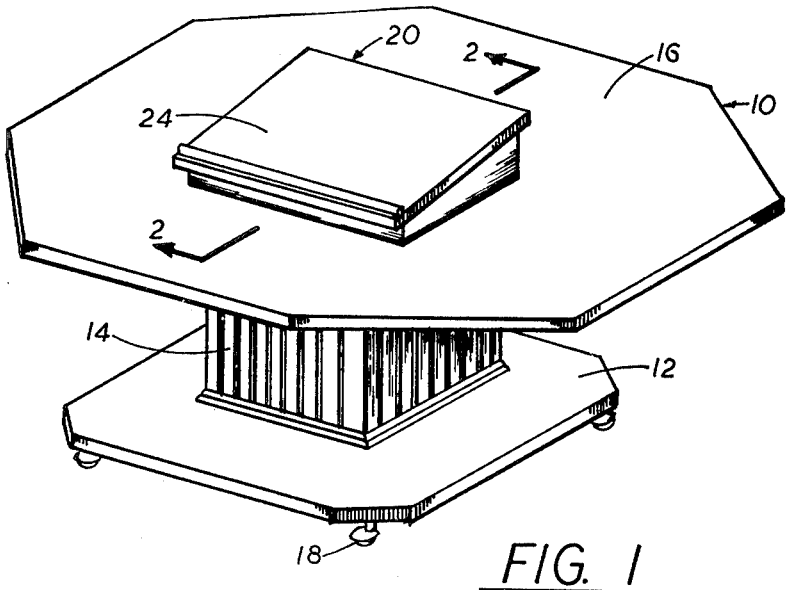
FIG. 1 shows an oblique projection of a table for use in religious services or otherwise thus illustrating one preferred embodiment of my invention.
Figure 2:
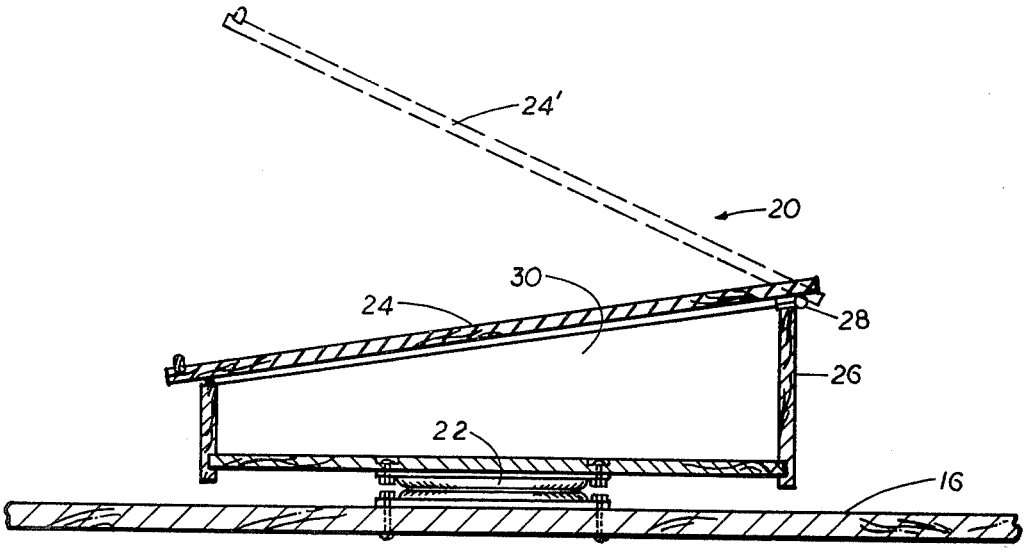
FIG. 2 shows a cross-sectional side elevational view of the table of FIG. 1 as viewed along cross-section lines 2—2 of the latter figure.

Referring now to FIGS. 1–2, there is shown, in one preferred embodiment of my invention, a table 10 for individual or group worship, scripture reading, prayer, meditation or other form of service. The table 10 includes a relatively broad base plate 12, a rectangular supporting column 14 mounted on the base plate 12 and a table top 16. The table top 16 forms a relatively broad, flat multi-sided surface which, in the present example, is a regular octagon permitting up to eight persons to gather therearound. It is preferable that the elevation of the table top 16 above the floor be convenient for kneeling about the same, for example, about 18–20 inches high, although the height of the table top 16 is a matter of individual choice. The base plate 12, supporting column 14, and table top 16 should preferably be constructed of wood to form an attractive furnishing for use in the home, although other materials may be substituted therefor. The base plate 12 may also be fitted with casters or rollers 18.

A book or scripture supporting lectern 20 is mounted by means of a conventional swivel 22 to a central portion of the table top 16 so that the lectern 20 may be rotated for use by a person kneeling at any one of the eight sides of the table top 16. The lectern 20 includes a slanted lid 24 connected to a wall 26 by means of hinges 28 so that the lid 24 may be raised, as indicated in FIG. 2 by dashed lines 24', to provide access to a storage chamber 30 where materials for use in a religious service may be conveniently stored.

Figure 3:
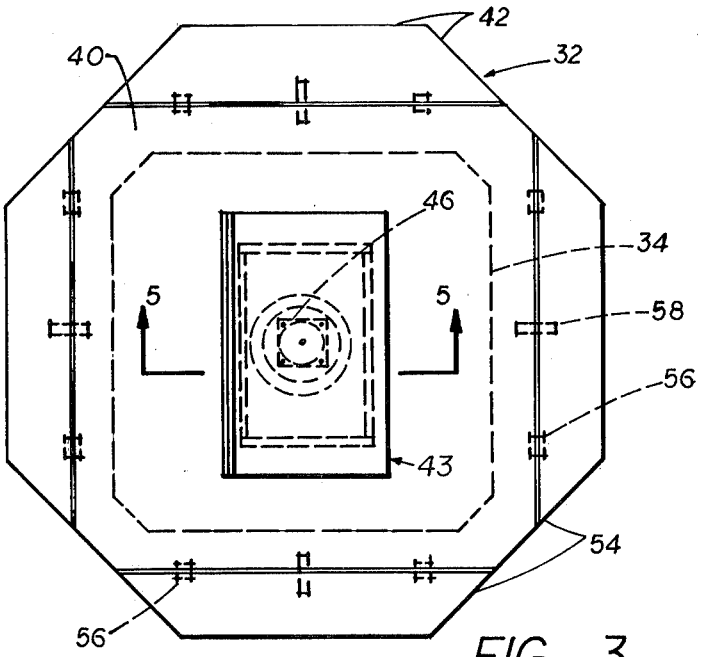
FIG. 3 shows a top plan view of a table for use in religious services or otherwise thus illustrating another preferred embodiment of my invention.
Figure 4:
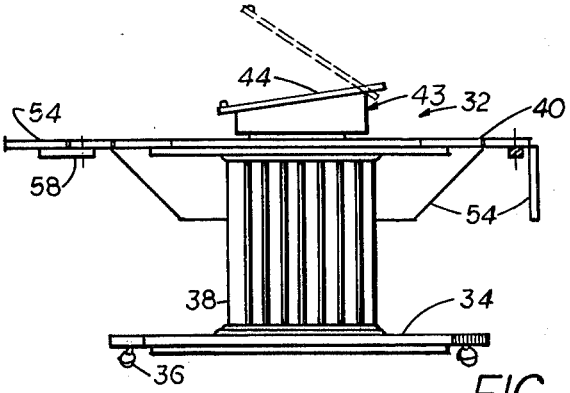
FIG. 4 shows an elevational view of the table of FIG. 3 with certain leaves of the table shown in a lowered position.
Figure 5:
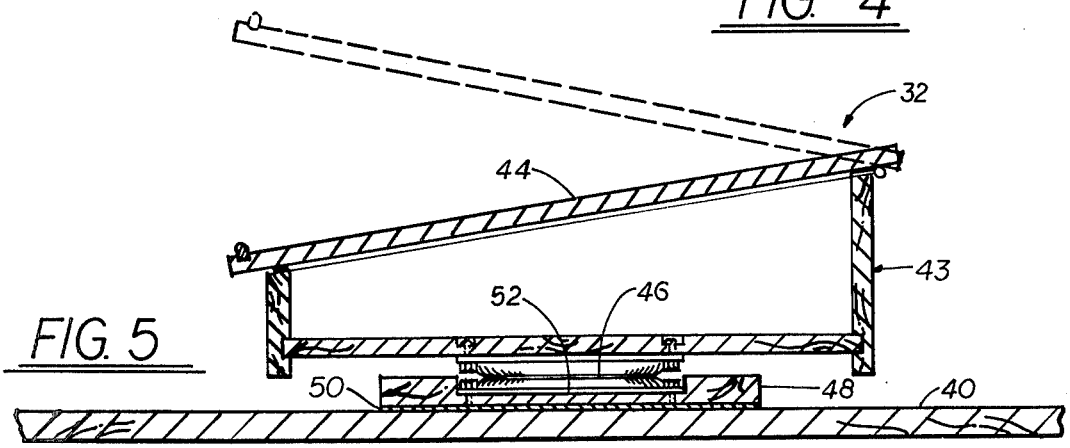
FIG. 5 shows a cross-sectional elevational view of a portion of the table of FIG. 3 as viewed along lines 5—5 thereof.

Referring now to FIGS. 3–5, there is shown, in another preferred embodiment of my invention, a table 32 having a broad base plate 34, with a set of rollers 36 attached, a rectangular supporting column 38, and a table top 40 having eight equal length sides 42. As in the previous example, the table top 40 should preferably be located at a convenient height above the floor for persons to kneel therearound. A rotatable lectern 43 is provided having a hinged book supporting slanted lid 44. The lectern 43 is attached to a conventional swivel 46 which is, in turn, mounted on a circular disc shaped base 48. The base 48 is removably disposed on a central portion of the table top 40 so that the lectern 43 can be removed from the table top 40 as desired. A layer of soft, non-abrasive felt 50 or other suitable material is attached in the usual, well known manner to the bottom of the base 48 to prevent scratching or marrying of the table top 40. The swivel 46 may be disposed within a recess 52 formed in the base 48 so that the lectern 43 is not excessively elevated above the table top 40.

An additional feature of the present example of my invention is the formation of four drop leaves 54 connected to a stationary central portion of the table top 40 by means of hinges 56. Four rotatable elongated drop leaf restrainers 58 are adapted for turning by hand in the usual manner to maintain the leaves 54 in a raised horizontal position or to permit the leaves 54 to be folded downward to a space saving vertical position (see particularly FIG. 4).

Thus, the table 32 forms an attractive and convenient furnishing for religious services in the home. When not needed for that purpose, the lectern 43 may be removed from the table top 40 and the leaves 54 may be lowered for space saving or for a multitude of other uses such as a TV, magazine or coffee table, for example.

Although the subject invention has been described with respect to specific details of certain preferred embodiments thereof, it is not intended that such details limit the scope of the present invention otherwise than as set forth in the following claims.

I claim:

1. A table for use in religious services and otherwise comprising a multi-sided table top, and a rotatable lectern removably mounted on said table top for rotation into alignment with each of the sides of said top, said lectern comprising, wall structure defining a chamber therein, a book supporting lid hingably attached to said wall structure adapted for lifting to provide external access to said chamber, a plate removably mounted on said table top and forming a base defining a recess therein, swivel means disposed at least partially within said recess and attached to said base, said swivel means also being connected to said lectern.

2. The table of claim 1 wherein said table top forms a regular octagon.

3. The table of claim 1 wherein said table top is elevated above a supporting floor at a height convenient for persons to kneel therearound.

4. The table of claim 1 wherein said table top comprises a stationary central portion, and a plurality of drop leaves hingably attached to said stationary portion.

5. The table of claim 1 further comprising a relatively broad flat base, and a supporting column mounted on a central portion of said relatively broad flat base and supporting said table top at a height above said base which is convenient for persons to kneel around said table top.

6. The table of claim 1 further comprising a layer of soft, non-abrasive material attached to the bottom of said base plate for preventing scratching or marring of said table top by said base plate.

* * * * *